US006915658B2

(12) United States Patent
Lee et al.

(10) Patent No.: US 6,915,658 B2
(45) **Date of Patent: *Jul. 12, 2005**

(54) ACCUMULATOR AND AIR CONDITIONING SYSTEM USING THE SAME

(75) Inventors: Won Hee Lee, Seoul (KR); Yoon Jei Hwang, Seoul (KR); Chan Ho Song, Gwacheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/716,539

(22) Filed: Nov. 20, 2003

(65) Prior Publication Data

US 2004/0099007 A1 May 27, 2004

(30) Foreign Application Priority Data

Nov. 23, 2002 (KR) ..... 10-2002-0073287

(51) Int. Cl.[7] ..... F25B 43/00; F25B 1/00; B01D 41/00; B01D 19/00

(52) U.S. Cl. ..... 62/503; 62/512; 62/498; 96/188; 96/189; 96/197; 96/220; 55/424; 55/426

(58) Field of Search ..... 62/503, 498, 512; 96/188, 189, 197, 220; 55/424, 426

(56) References Cited

U.S. PATENT DOCUMENTS

| | | | | | |
|---|---|---|---|---|---|
| 5,396,776 | A | * | 3/1995 | Kim | 62/115 |
| 5,404,730 | A | * | 4/1995 | Westermeyer | 62/470 |
| 5,551,255 | A | * | 9/1996 | Rothfleisch | 62/502 |
| 5,605,058 | A | * | 2/1997 | Kurachi et al. | 62/503 |
| 5,966,952 | A | * | 10/1999 | Misawa et al. | 62/159 |
| 6,449,980 | B1 | * | 9/2002 | Minister | 62/513 |
| 6,519,971 | B1 | * | 2/2003 | Kim | 62/503 |

FOREIGN PATENT DOCUMENTS

| | | | | |
|---|---|---|---|---|
| JP | 2-154957 | * | 6/1990 | 62/503 |

* cited by examiner

*Primary Examiner*—Cheryl Tyler
*Assistant Examiner*—Filip Zec
(74) *Attorney, Agent, or Firm*—Greenblum & Bernstein, P.L.C.

(57) ABSTRACT

An accumulator having a heater therein and an air conditioning system using the same is disclosed, in which the accumulator includes a body having an empty space therein; an inlet tube inserted into the inside of the body through a predetermined external point, for an inflow of a refrigerant to the inside of the body; an outlet tube inserted into the inside of the body from a predetermined external point, for a discharge of the refrigerant to the outside of the body; and at least one heater provided in the inside of the body, for heating the flowing refrigerant.

20 Claims, 4 Drawing Sheets

ACCUMULATOR AND AIR CONDITIONING SYSTEM USING THE SAME

This application claims the benefit of the Korean Application No. P2002-0073287 filed on Nov. 23, 2002, which is hereby incorporated by reference.

BACKGROUND OF THE INVENTION

1. Field of the Invention

The present invention relates to an air conditioning system, and more particularly, to an improved accumulator and an air conditioning system using the same.

2. Discussion of the Related Art

Generally, an air conditioning system is a system to heat an indoor room by use of a phenomenon of radiating heat into the surroundings when a refrigerant is condensed, and to cool an indoor room by use of a phenomenon of absorbing heat into the surroundings when a refrigerant is vaporized.

FIG. 1 illustrates one example of an air conditioning system simultaneously performing cooling and heating operations. Referring to FIG. 1, the air conditioning system is provided with an outdoor unit 10 and an indoor unit 20, largely. At this time, the outdoor unit 10 is provided with a compressor 11, a flowing control valve 12, a first expansion device 15, an outdoor heat exchanger 13 and an accumulator 14. Also, the indoor unit 20 is provided with an indoor heat exchanger 22 and a second expansion device 21. Herein, the outdoor and indoor heat exchangers 13 and 22 are respectively adjacent to an outdoor fan 13*a* and an indoor fan 22*a*.

Hereinafter, a connection structure of the aforementioned components by tubes will be described in detail.

First, a first tube 33 connects an outlet 11*a* of the compressor 11 to a first port 12*a* of the flowing control valve 12, and a second tube 34 connects a third port 12*c* of the flowing control valve 12 to an inlet of the accumulator 14. Also, a third tube 35 connects an outlet of the accumulator 14 to an inlet 11*b* of the compressor 11, and a fourth tube 36 connects a second port 12*b* of the flowing control valve 12 to one end of the outdoor heat exchanger 13. Then, a fifth tube 31 connects the other end of the outdoor heat exchanger 13 to one end of the indoor heat exchanger 22. At this time, the respective first and second expansion devices 15 and 21 are provided in the fifth tube 31 for being positioned in the indoor unit 10 and the outdoor unit 20. Meanwhile, a sixth tube 32 connects the other end of the indoor heat exchanger 22 to a fourth port 12*d* of the flowing control valve 12.

In the air conditioning system having the aforementioned structure, the accumulator 14 is formed in a container shape having an empty space therein, such as a cylinder. At this time, the inlet of the accumulator 14 is connected to the second tube 34 for providing a refrigerant, and the outlet of the accumulator 14 is connected to the third tube 35 for discharging the refrigerant. After the accumulator 14 receives, temporarily stores and stabilizes the refrigerant passing through the indoor or outdoor heat exchanger 13 or 22, the accumulator 14 provides only gas phase refrigerant to the compressor 11.

Hereinafter, an operation of the air conditioning system will be described in brief. For reference, a solid arrow indicates a refrigerant flow when cooling the indoor room, and a dotted arrow indicates a refrigerant flow when heating the indoor room.

First, on a cooling operation mode of the air conditioning system, the refrigerant discharged from the outlet 11*a* of the compressor 11 flows into the outdoor heat exchanger 13 by a guide of the flowing control valve 12. The refrigerant condensed in the outdoor heat exchanger 13 passes through the first expansion device 14, which is completely open, and then expanded in the second expansion device 21. Subsequently, the refrigerant absorbs the surrounding heat in the indoor heat exchanger 22 when the refrigerant expanded in the second expansion device 21 is vaporized in the indoor heat exchanger 22. At this time, the indoor room is ventilated with a cold air surrounding the indoor heat exchanger 22 by the indoor fan 22*a*, whereby the indoor room is cooled. After cooling the indoor room, the gas phase refrigerant flows into the accumulator 14 by a guide of the flowing control valve 12. At this time, the refrigerant flows into the accumulator 14 at a high pressure. That is, the refrigerant is sprayed to the inner space of the accumulator 14 from the end of the second tube 34. Thus, the gas phase refrigerant flowing to the accumulator 14 is discharged through the third tube 35, and then flows into the inlet 11*b* of the compressor 11.

On a heating operation mode of the air conditioning system, the refrigerant discharged from the compressor 11 flows into the indoor heat exchanger 22 by a guide of the flowing control valve 12. Then, when the refrigerant is condensed in the indoor heat exchanger 22, the refrigerant radiates condensing heat to the surroundings. At this time, the indoor fan 22*a* discharges the heat radiated from the indoor heat exchanger 22 to the indoor room, so that the indoor room is heated. After that, the refrigerant condensed in the indoor heat exchanger 22 passes through the second expansion device 21, which is completely open, and then expanded in the first expansion device 15. Herein, the refrigerant expanded in the first expansion device 15 passes through the outdoor heat exchanger 13, the flowing control valve 12 and the accumulator 14, sequentially, and then flows into the inlet 11*b* of the compressor 11.

However, the related art air conditioning system for cooling or heating the indoor room has the following disadvantages.

If the air conditioning system is continuously operated for heating the indoor room in the winter season at an outdoor temperature of 5° C. or less, the surface of the outdoor heat exchanger 13 is covered with a frost, thereby lowering heat exchange efficiency of the outdoor heat exchanger 13 and the air conditioning efficiency.

According to the frost on the surface of the outdoor heat exchanger 13, the temperature of the refrigerant flowing into the accumulator 14 becomes low, whereby the temperature of the refrigerant flowing into the compressor 11 becomes low. Thus, power consumption for compressing the refrigerant in the compressor 11 increases. Also, the temperature of the refrigerant flowing to the air conditioning system becomes low, whereby it accelerates a phenomenon of generating the frost on the surface of the outdoor heat exchanger 13, thereby lowering the air conditioning efficiency.

On the heating operation mode of the air conditioning system, the refrigerant temperature of the accumulator 14 is low, whereby the refrigerant may be maintained in liquid phase, and the liquid phase refrigerant may flow into the compressor 11. Thus, it causes a noise in the compressor 11, and lowering of compression efficiency, thereby lowering air conditioning efficiency.

SUMMARY OF THE INVENTION

Accordingly, the present invention is directed to an improved accumulator and an air conditioning system using the same that substantially obviates one or more problems due to limitations and disadvantages of the related art.

An object of the present invention is to provide an improved accumulator and an air conditioning system using the same, in which it is possible to prevent a liquid phase refrigerant from flowing into a compressor.

Another object of the present invention is to provide an improved accumulator and an air conditioning system using the same, for preventing a frost from being on a surface of an outdoor heat exchanger on a heating operation mode.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an accumulator includes a body having an empty space therein; an inlet tube inserted into the inside of the body through a predetermined external point, for an inflow of a refrigerant to the inside of the body; an outlet tube inserted into the inside of the body from a predetermined external point, for a discharge of the refrigerant to the outside of the body; and at least one heater provided in the inside of the body, for heating the flowing refrigerant.

At this time, the inlet tube is provided in parallel with the outlet tube. Also, the inlet tube is inserted into the inside of the body from a top of the body, downwardly, and the outlet tube is inserted into the inside of the body from a bottom of the body, upwardly. In this case, one end of the inlet tube is positioned at an inner lower portion of the body, and one end of the outlet tube is positioned at an inner upper portion of the body.

Meanwhile, the heater may be provided on an inner bottom of the body, and the height of the heater is at 70% or less of the entire body height. Also, in case at least two heaters are provided, each heater has different heating capacity, and the heaters are separately controlled for turning-on/off operations.

In another aspect, an air conditioning system includes at least one compressor for compressing a refrigerant at a high pressure, and discharging the refrigerant; a flowing control valve connected to the compressor, for controlling a flowing direction of the refrigerant according to an operation mode; a plurality of heat exchangers, for being respectively positioned indoor and outdoor, and connected to the flowing control valve; at least one expansion device provided in a refrigerant tube directly connecting the heat exchangers; and an accumulator temporarily storing the refrigerant passing through the heat exchangers, and connected to an inlet of the compressor for providing the gas phase refrigerant to the compressor. At this time, the accumulator has the same structure as that mentioned above.

In case the plurality of compressors are provided in the air conditioning system according to the present invention, the air conditioning system further includes a plurality of check valves, each provided between the outlet of each compressor and the flowing control valve, for preventing the refrigerant from flowing into the outlet of the compressor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an improved accumulator and an air conditioning system using the same according to the present invention will be described with reference to the accompanying drawings.

Figure 2:
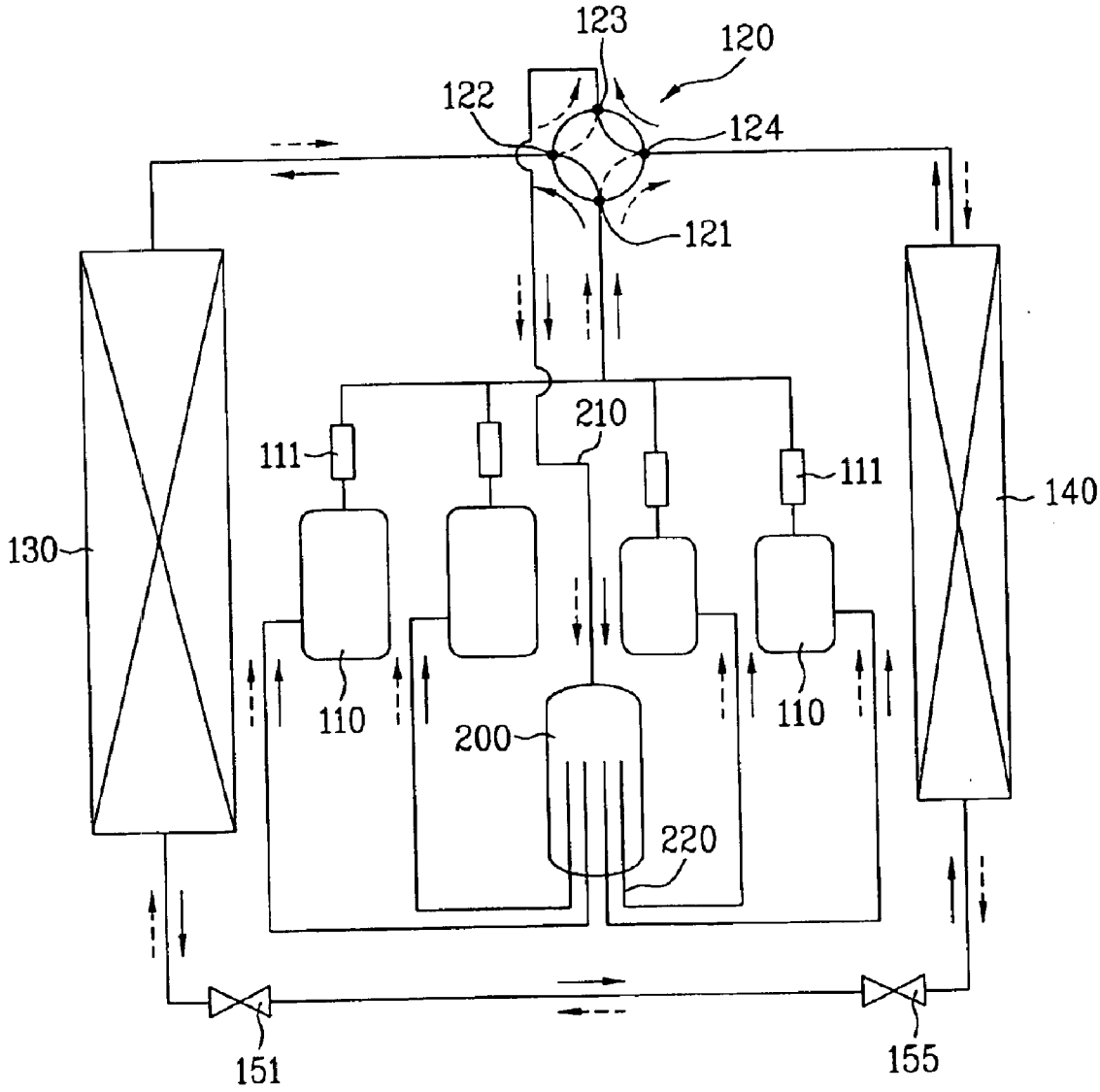
FIG. 2 is a schematic view illustrating one example of an air conditioning system having a plurality of compressors according to the present invention.

FIG. 2 is a schematic view illustrating one example of an air conditioning system having a plurality of compressors according to the present invention. Referring to FIG. 2, for example, four compressors 110 are provided, in which each compressor may have the same or different capacity, or some of them may have the same capacity, and the other may have the different capacity. In case of providing the plurality of compressors 110, it is possible to control the operation number of the compressors 110 according to load capacity required for cooling or heating an indoor room, thereby improving energy efficiency. Thus, it provides optimal air conditioning service according to the environment of the indoor room.

Figure 1:
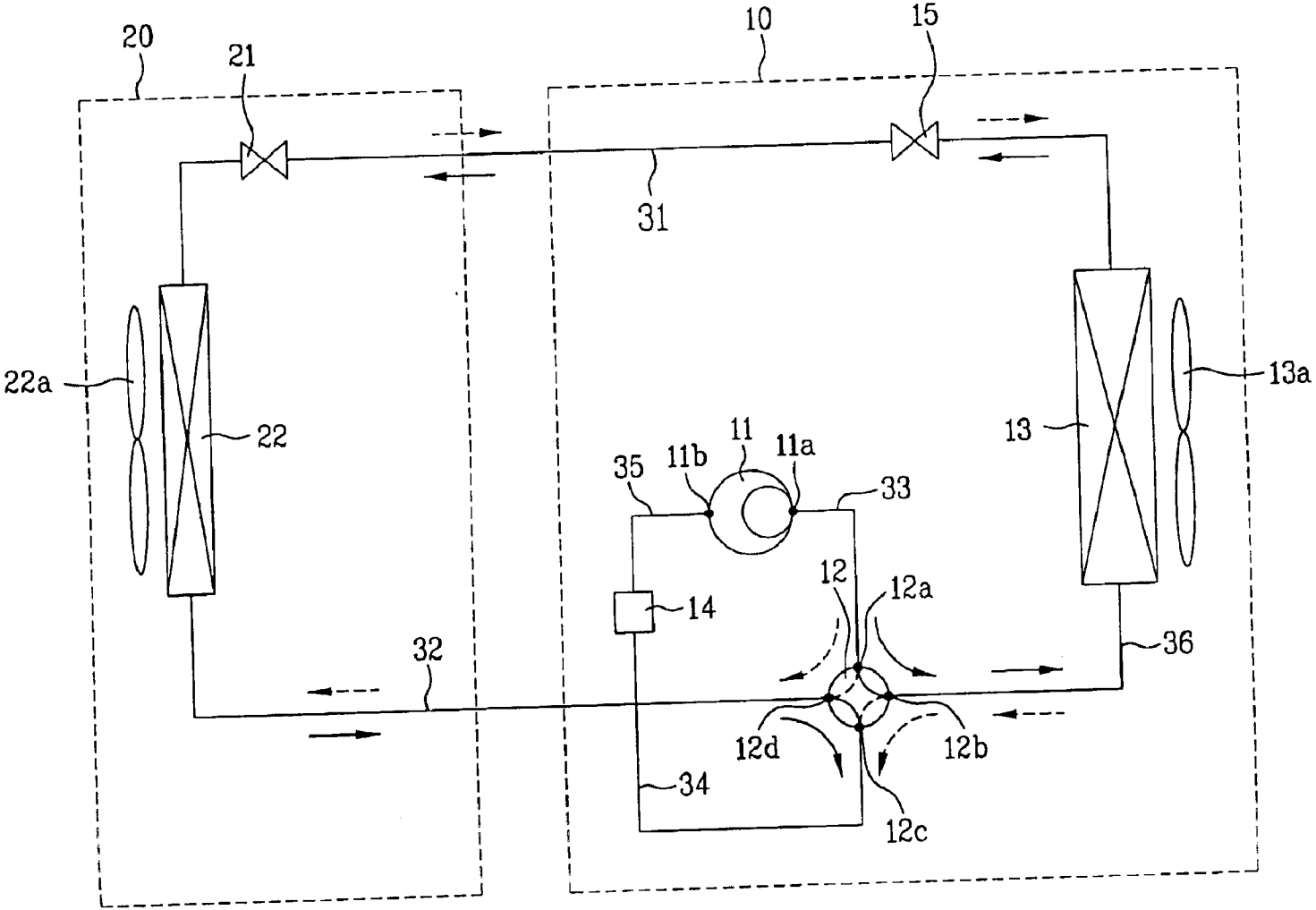
FIG. 1 is a schematic view illustrating one example of a related art air conditioning system performing cooling and heating operations.

When providing the plurality of compressors 110 in the air conditioning system, as shown in FIG. 2, a check valve 111 may be provided to each outlet of the compressors 110. The check valve 111 is provided between the outlet of the compressor 110 and a first port 121 of a flowing control valve 120, for passing a refrigerant discharged from the compressor 110, and blocking the flow of the refrigerant flowing toward the outlet of the compressor 110. Thus, the check valve 111 prevents the refrigerant from flowing into the outlet of the compressor 110 that is not operated, effectively. Also, in the air conditioning system according to the present invention, it is possible to provide one compressor instead of the plurality of compressors, as shown in FIG. 1. In this case, it is preferable to provide a variable compressor.

Referring to FIG. 2, the flowing control valve 120 is provided with four ports of the first port 121, a second port 122, a third port 123 and a fourth port 124. The first port 121 is connected to the inlet of each compressor 110, and the second port 122 is connected to one side of a first heat exchanger 130, as shown in FIG. 2. Also, the third port 123 is connected to an accumulator 200, and the fourth port 124 is connected to one side of a second heat exchanger 140.

At this time, the first heat exchanger 130 is provided outdoor, and the second heat exchanger 140 is provided indoor. As shown in FIG. 2, the first and second heat exchangers 130 and 140 are connected to each other through a refrigerant tube, the refrigerant tube having a plurality of expansion devices. In FIG. 2, two expansion devices, first and second expansion devices 151 and 155, are respectively provided for being in adjacent to the first and second heat exchangers 130 and 140. The first expansion device 151 passes the refrigerant flowing from the first heat exchanger 130 to the second heat exchanger 140, and expands the refrigerant flowing from the second heat exchanger 140 to the first heat exchanger 130. Also, the second expansion device 155 passes the refrigerant flowing from the second heat exchanger 140 to the first heat exchanger 130, and expands the refrigerant flowing from the first heat exchanger 130 to the second heat exchanger 140.

In case of the accumulator 200 shown in FIG. 2, an inlet tube 210 is connected to the third port 123 of the flowing control valve 120, and an outlet tube 220 is connected to the inlet of each compressor 110. The accumulator 200 temporarily stores and stabilizes the refrigerant passing through the first or second heat exchanger 130 or 140, discharges the gas phase refrigerant, and provides the gas phase refrigerant to the compressor 110.

Figure 3:
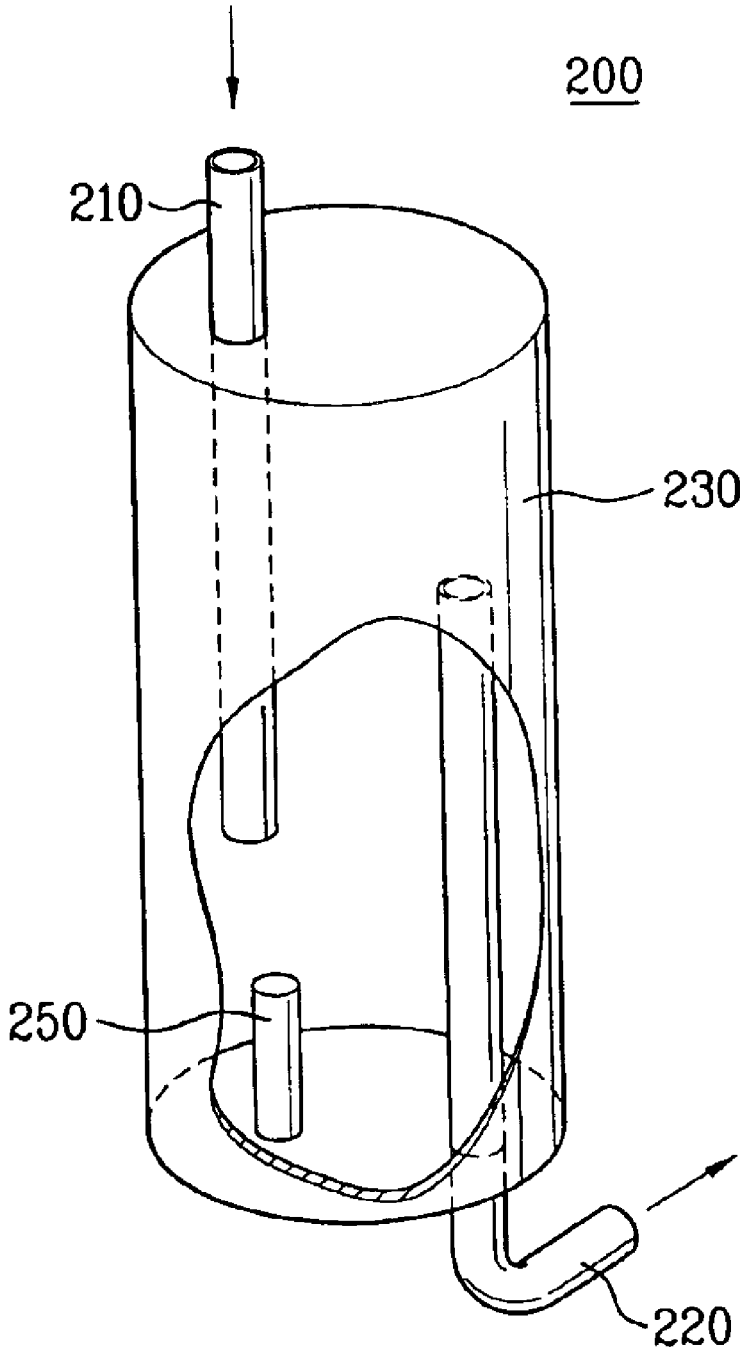
FIG. 3 is a partially cutaway perspective view illustrating an accumulator according to one preferred embodiment of the present invention.
Figure 4:
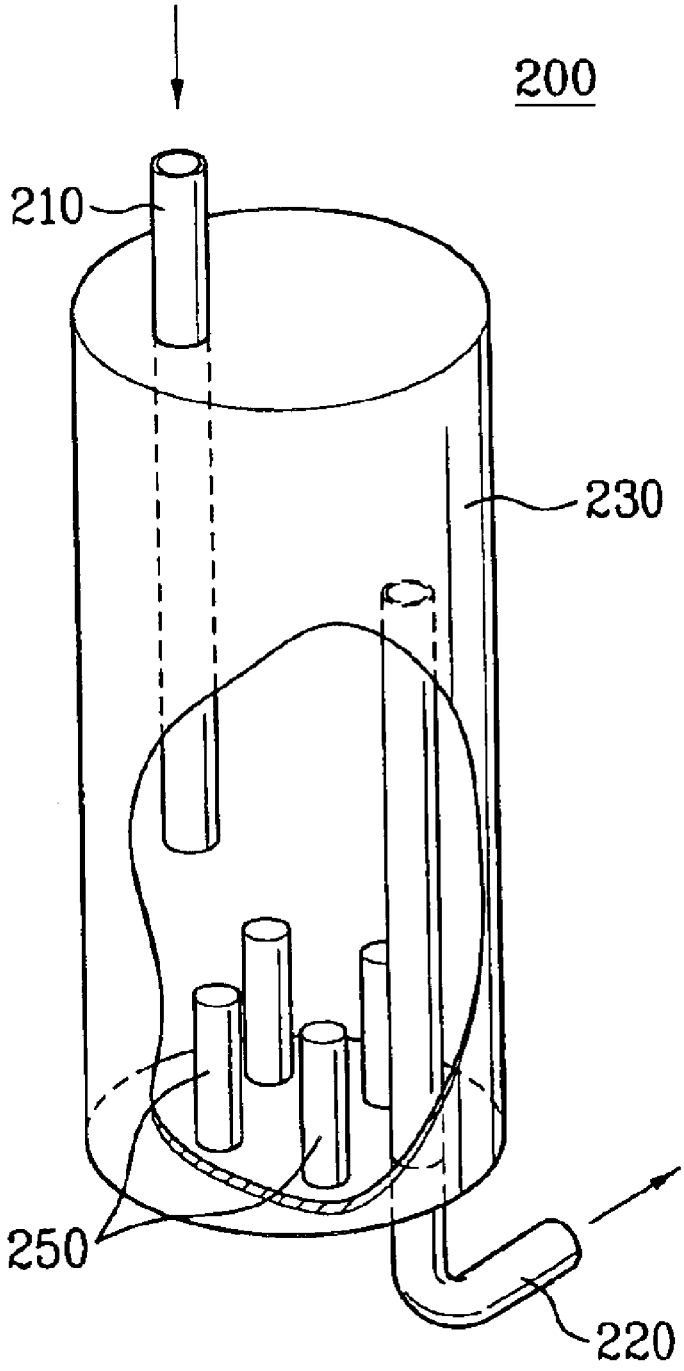
FIG. 4 is a partially cutaway perspective view illustrating an accumulator according to another preferred embodiment of the present invention.

Hereinafter, a structure of the accumulator 200 will be described with reference to FIG. 3 and FIG. 4. FIG. 3 is a partially cutaway perspective view illustrating an accumulator according to one preferred embodiment of the present invention, and FIG. 4 is a partially cutaway perspective view illustrating an accumulator according to another preferred embodiment of the present invention.

Referring to FIG. 3, the accumulator 200 is provided with a body 230, an inlet tube 210, an outlet tube 220 and a heater 250. At this time, the body 230 is formed of a container shape having an empty space therein, such as a cylinder. Also, the inlet tube 210 is connected to the third port 123 of the flowing control valve 120. Then, as shown in FIG. 2 and FIG. 3, the inlet tube 210 is inserted into the inner space of the body 230 through a predetermined external point, for example, one point on a top of the body 230, downwardly. Preferably, one end of the inlet tube 210 is positioned at an inner lower portion of the body 230.

As shown in FIG. 2 and FIG. 3, the outlet tube 230 is connected to the inlet of each compressor 110. Then, the outlet tube 230 is inserted into the inner space of the body 230 through a predetermined external point, for example, one point on a bottom of the body 230, upwardly. Preferably, one end of the inlet tube 210 is positioned at an inner upper portion of the body 230. Meanwhile, as shown in FIG. 3, it is preferable to position the inlet tube 210 and the outlet tube 220 for being in parallel with each other.

The heater 250 is positioned in the inside of the body 230. Preferably, the heater 250 is positioned on an inner bottom of the body 230, or an inner surface of the body 230, as shown in FIG. 3. If the heater 250 is positioned on the inner bottom of the body 230, the heater 250 directly heats the refrigerant temporarily stored in the inside of the body 230, especially liquid phase refrigerant, thereby vaporizing an amount of liquid phase refrigerant with a small amount of heat.

Preferably, the height of the heater 250 is at 70% or less of an entire body height 250. Thus, the heater 250 is completely immersed in the liquid phase refrigerant stored in the inside of the body 230. That is, it is possible to effectively prevent the front end of the heater 250 from being overheated. Meanwhile, as shown in FIG. 3 and FIG. 4, the heater 250 is formed in a stick shape. However, it is possible to form the heater 250 in various shapes. For example, the heater 250 may be formed in a coil shape. Also, the heater 250 may be provided on an outer surface of the body 230 as well as on the inner surface of the body 230.

As shown in FIG. 4, the accumulator may have the plurality of heaters 250. At this time, the number of heaters 250 is determined in due consideration of the number of compressors 110, heating capacity of the heater 250, and the flowing amount of the refrigerant. For example, in case of the air conditioning system having one compressor, the flowing amount of the refrigerant is less, so that one or two-heaters 250 provided in the inside of the body 230 are enough for heating the refrigerant in the air conditioning system. However, in case of the air conditioning system having the four compressors, the flowing amount of the refrigerant is great, so that it is required to provide the four heaters 250 in the inside of the body 230 for heating the refrigerant in the air conditioning system.

If the plurality of heaters 250 are provided in the inside of the body 230, it is preferable to control turning-on/off operations of the heaters 250 separately. At this time, each heater 250 may have different heating capacity. In this state, if the operation number of the compressors 110 and the flowing amount of the refrigerant are changed, the operation number of the heaters 250 is controlled to provide the optimal heating capacity for heating the refrigerant. Accordingly, it is possible to maintain the amount of the refrigerant flowing into the compressor 110, uniformly. However, it is not necessary to separately control the turning-on/off operations of the heaters 250. If necessary, it is possible to control the heaters 250, equally, according to the same operation mode.

Hereinafter, on an operation mode of the aforementioned air conditioning system according to the present invention, the flow of the refrigerant and the function of the accumulator 200 will be described as follows. The air conditioning system according to the present invention selectively operates a cooling operation mode for cooling the indoor room or a heating operation mode for heating the indoor room. For reference, a solid arrow indicates the refrigerant flow in the cooling operation mode of the air conditioning system, and a dotted arrow indicates the refrigerant flow in the heating operation mode of the air conditioning system according to the present invention.

Referring to FIG. 2, on the cooling operation mode of the air conditioning system according to the present invention, the flowing control valve 120 is controlled to connect the first port 121 to the second port 122, and to connect the third port 123 to the fourth port 124, simultaneously. Also, the operation number of the compressors 110 and the amount of flowing refrigerant are determined according to load capacity required for cooling the indoor room.

First, the refrigerant discharged from the compressor 110 flows into the first heat exchanger 130 provided outdoors by the guide of the flowing control valve 120. At this time, the check valve 111 prevents the discharged refrigerant from flowing into the compressor 110 that is not operated. As the refrigerant is condensed in the first heat exchanger 130, the refrigerant radiates condensing heat to the surroundings, whereby the heat radiated from the first heat exchanger 130 is discharged to the outdoor room. After the liquid phase refrigerant condensed in the first heat exchanger 130 passes through the first expansion device 151 and the second expansion device 155, sequentially, the liquid phase refrigerant is expanded. Then, the refrigerant absorbs the surrounding heat in the second heat exchanger 140 by vaporizing, so that the air is cooled. That is, the cooled air heat-exchanged by the second heat exchanger 140 is discharged into the indoor room, thereby cooling the indoor room.

The gas phase refrigerant vaporized in the second heat exchanger 140 flows into the accumulator 200 by the guide of the flowing control valve 120. At this time, most of the refrigerant flowing into the accumulator 200 is in the gas phase, but some refrigerant is in the liquid phase. However, in the air conditioning system according to the present invention, the heater 250 heats and vaporizes the liquid phase refrigerant, so that it is possible to prevent the inflow of the liquid phase refrigerant into the outlet tube 220. Accordingly, in the accumulator 200 of the air conditioning system according to the present invention, only gas phase refrigerant flows into the compressor 110, thereby preventing noise, lowering of compression efficiency, and operational problems by the inflow of the liquid phase refrigerant. Also, the air conditioning system according to the present invention prevents cooling efficiency from being lowered.

Next, on the heating operation mode of the air conditioning system according to the present invention, the flowing control valve 120 is controlled to connect the first port 121 to the fourth port 124, and to connect the second port 122 to the third port 123. Also, the operation number of the compressors 110 and the amount of flowing refrigerant are determined according to load capacity required for heating the indoor room.

The gas phase refrigerant discharged from the compressor 110 flows into the second heat exchanger 140 provided indoors by the guide of the flowing control valve 120. Then, when the refrigerant is condensed in the second heat exchanger 140, the refrigerant radiates heat to the surroundings, so that condensing heat is discharged to the indoor room, thereby heating the indoor room.

The liquid phase refrigerant condensed in the second heat exchanger 140 passes through the second expansion device 155, and then is expanded in the first expansion device 151. Also, the refrigerant is vaporized in the first heat exchanger 130 provided indoors, thereby absorbing surrounding heat. The refrigerant vaporized through the second heat exchanger 140 passes through the flowing control valve 120, and then flows into the accumulator 200. According to the aforementioned process, only gas phase refrigerant flows into the compressor 110 in the accumulator according to the present invention.

Generally, when heating the indoor room, the temperature of the outdoor room is low. Accordingly, in case the first heat exchanger continuously performs heat exchange with the low-temperature outdoor air, the first heat exchanger 130 has the frost on the surface thereof, thereby lowering heat-exchanging and heating efficiency.

For preventing the surface of the first heat exchanger 130 from being frosted over, the heater 250 heats the refrigerant temporarily stored in the accumulator 200. Thus, the temperature of the refrigerant flowing inside the air conditioning system goes up, and the temperature of the refrigerant vaporized in the first heat exchanger 130 goes up, thereby preventing the surface of the first heat exchanger 130 from being frosted over. Accordingly, it is possible to prevent lowering of heat-exchange and heating efficiency.

As mentioned above, the improved accumulator and the air conditioning system using the same according to the present invention has the following advantages.

The accumulator according to the present invention prevents the liquid phase refrigerant from flowing into the compressor, so that it is possible to prevent the noise from generating when the liquid phase refrigerant flows into the compressor, and to prevent the compression efficiency from being lowered. Also, as the compression efficiency goes up, the cooling or heating efficiency is improved, thereby obtaining cut-down of energy consumption.

On the heating operation mode of the air conditioning system according to the present invention, the heater heats the refrigerant flowing inside the accumulator, thereby preventing the surface of the first heat exchanger from being frosted over. Accordingly, the heat-exchange and heating efficiency is improved in the air conditioning system according to the present invention. Also, the heater has the low height, so that the heater is completely immersed in the liquid phase refrigerant, thereby preventing overheating and damages of the heater.

Furthermore, the air conditioning system according to the present invention controls the turning-on/off operations of the heaters separately, and each heater has the different heating capacity. Accordingly, it is possible to provide the optimal heating capacity according to the operation number of the compressors and the flowing amount of the refrigerant. That is, the gas phase refrigerant is provided to the compressor in the predetermined amount, thereby improving reliability of the compressor.

In the aforementioned preferred embodiment of the present invention, the air conditioning system for cooling or heating one room is disclosed. However, the improved accumulator according to the prevent invention may be applicable to a multi-air conditioning system for cooling or heating a plurality of rooms according to the same method in that it is possible to exchange the related art accumulator for the improved accumulator according to the present invention without a system structural change.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An accumulator comprising:

a body having a space therein;

an inlet tube extending downwardly into the body from a predetermined external point at a top of the body and including an end positioned at an inner lower portion of the body, such that a refrigerant flows into the body;

an outlet tube extending upwardly into the body from a predetermined external point at a bottom of the body and including an end positioned at an inner upper portion of the body, such that the refrigerant is discharged from the body; and at least one heater provided in the body, for heating the refrigerant.

2. The accumulator of claim 1, wherein the inlet tube extends in parallel with the outlet tube.

3. The accumulator of claim 1, wherein the heater is provided on an inner bottom of the body.

4. The accumulator of claim 3, wherein a height of the heater is not more than 70% of the entire body height.

5. The accumulator of claim 1, wherein at least two heaters are provided.

6. The accumulator of claim 5, wherein each heater has a different heating capacity.

7. The accumulator of claim 5, wherein the heaters are separately turned on and off.

8. An air conditioning system comprising:

at least one compressor that compresses a refrigerant at a high pressure and that discharges the compressed refrigerant;

a flow control valve connected to the compressor, for controlling a flow direction of the refrigerant according to an operation mode;

a plurality of heat exchangers respectively positioned indoor and outdoor and connected to the flow control valve;

at least one expansion device provided in a refrigerant tube that connects the heat exchangers; and an accumulator that temporarily stores the refrigerant passing through the heat exchangers, and that is connected to an inlet of the compressor such that the gas phase refrigerant is provided to the compressor, said accumulator comprising:

a body having a space therein;

an inlet tube, extending downwardly into the body from an external point at a top of the body, and including an end positioned at an inner lower portion of the body, such that a refrigerant flows into the body;

an outlet tube, extending upwardly into the body from an external point at a bottom of the body, and including an end positioned at an inner upper portion of the body, such that the refrigerant is discharged from the body; and at least one heater provided in the body, for heating the refrigerant.

9. The air conditioning system of claim 8, further comprising:

a plurality of check valves, each provided between the outlet of one of the at least one compressors and the flow control valve, such that the refrigerant is prevented from flowing into the outlet of the compressor.

10. The air conditioning system of claim 8, each of the compressors has a different capacity.

11. The air conditioning system of claim 8, the inlet tube extends in parallel with the outlet tube.

12. The air conditioning system of claim 8, wherein the heater is provided on an inner bottom of the body.

13. The air conditioning system of claim 12, wherein the height of the heater is not more than 70% of the entire body height.

14. The air conditioning system of claim 8, wherein at least two heaters are provided.

15. The air conditioning system of claim 14, wherein each heater has a different heating capacity.

16. The air conditioning system of claim 14, wherein the heaters are separately turned on and off.

17. An accumulator comprising:

a body having a space therein;

an inlet tube extending into the body through a top of the body for introducing refrigerant into the body, and including an end positioned at an inner lower portion of the body; and an outlet tube extending into the body through a bottom of the body for exhausting a gas phase refrigerant from the body, and including an end positioned at an inner upper portion of the body.

18. The accumulator as claimed in claim 17, wherein the end of the outlet tube is positioned higher than the end of the inlet tube so as to prevent a liquid phase refrigerant introduced into the body through the inlet tube from flowing into the outlet tube directly.

19. The accumulator as claimed in claim 17, further comprising:

a heater provided on the bottom of the body, wherein the heater heats a liquid phase refrigerant gathered in the inner lower portion of the body.

20. An air conditioning system comprising:

a compressor that compresses and pumps refrigerant;

an indoor heat exchanger that communicates with the compressor and conducts a heat exchange between the refrigerant and the indoor air;

an outdoor heat exchanger that communicates with the compressor and conducts a heat exchange between the refrigerant and the outdoor air; and an accumulator that communicates with the compressor and heat exchangers, said accumulator comprising:

a body having a space therein;

an inlet tube extending into the body through a top of the body, said inlet tube introducing refrigerant into the space and including an end positioned at an inner lower portion of the body; and an outlet tube extending into the body through a bottom of the body, said outlet tube exhausting a gas phase refrigerant from the space and including an end positioned at an inner upper portion of the body.

* * * * *

UNITED STATES PATENT AND TRADEMARK OFFICE

CERTIFICATE OF CORRECTION

PATENT NO. : 6,915,658 B2
DATED : July 12, 2005
INVENTOR(S) : W. H. Lee et al.

It is certified that error appears in the above-identified patent and that said Letters Patent is hereby corrected as shown below:

Column 9,
Lines 40 and 42, after “claim 8,” insert -- wherein --.

Signed and Sealed this

Fourteenth Day of March, 2006

JON W. DUDAS
*Director of the United States Patent and Trademark Office*